United States Patent [19]

Rieck et al.

[11] Patent Number: 4,728,443

[45] Date of Patent: Mar. 1, 1988

[54] TEXTILE SOFTENING DETERGENT COMPOSITION

[75] Inventors: Hans-Peter Rieck, Hofheim; Jürgen Grosse, Erftstadt; Werner Gohla, Niederkassel, all of Fed. Rep. of Germany

[73] Assignee: Hoechst Aktiengesellschaft, Fed. Rep. of Germany

[21] Appl. No.: 725,376

[22] Filed: Apr. 22, 1985

[30] Foreign Application Priority Data

May 5, 1984 [DE] Fed. Rep. of Germany ..... 3416669

[51] Int. Cl.[4] ..... D06M 11/00

[52] U.S. Cl. ..... 252/8.6; 252/135

[58] Field of Search ..... 252/8.6, 135

[56] References Cited

U.S. PATENT DOCUMENTS

| | | | |
|---|---|---|---|
| 4,436,637 | 3/1984 | Ramachandran et al. | 252/8.6 |
| 4,469,605 | 9/1984 | Ramachandran et al. | 252/8.6 |
| 4,524,012 | 6/1985 | Wixon | 252/8.6 |
| 4,526,702 | 7/1985 | Parr et al. | 252/8.6 |
| 4,536,316 | 8/1985 | Ramachandran | 252/8.6 |
| 4,578,258 | 3/1986 | Rieck | 423/325 |

FOREIGN PATENT DOCUMENTS

| | | |
|---|---|---|
| 3400130 | 7/1985 | Fed. Rep. of Germany . |
| 3400132 | 7/1985 | Fed. Rep. of Germany . |

*Primary Examiner*—Paul Lieberman
*Assistant Examiner*—Willie J. Thompson
*Attorney, Agent, or Firm*—Connolly and Hutz

[57] ABSTRACT

A textile softening detergent composition contains from 5 to 70 wgt % surfactant, from 0.5 to 50 wgt % builder, from 1 to 20 wgt % crystalline laminated silicic acid and/or a corresponding alkali metal silicate and standard detergent aids. It is characterized in that the crystalline laminated silicic acid or its alkali metal salt of the general formula $$M_2Si_xO_{2x+1} \cdot y\ H_2O$$

in which x stands for a number larger than 7.0, M stands for sodium, potassium or hydrogen, and y stands for a number of from 0 to 25, shows one or more reflexes unassignable to quartz, tridymite and cristobalite in the X-ray diffraction diagram in the range of the d-values of $3.0–4.0 \cdot 10^{-8}$ cm. Process for rinsing textiles using the crystalline laminated silic acid or its alkali metal salts as a textile softening agent.

8 Claims, No Drawings

TEXTILE SOFTENING DETERGENT COMPOSITION

The present invention relates to a textile softening detergent composition.

It is known that soft and fluffy textiles frequently washed in a drum washing machine become deprived of their initially pleasant feeling. The feeling becomes harder, especially when the textiles are repeatedly dried, hanging quiescently. This is due to an agglutination of fibers, also termed water stiffness, which occurs during drying.

This effect can be acted upon with the use of conditioning agents, preferably cationic surfactants, more preferably quaternary ammonium compounds. The softening effect on the textile generally has an antistatic effect associated with it. The term "softening" as used herein always means this conditioning effect on textiles; it does not relate to the softening of water by sequestration of calcium and magnesium ions inducing the hardness of water, in complex form.

The cationic surfactants are normally not compatible with the anionic surfactants used in detergent compositions; in fact difficultly soluble matter is precipitated and the washing liquor becomes partially deprived of softening cationic surfactants and surface-active anionic surfactants whereby the efficiency of the detergent compositions is naturally impaired. In view of this, it has been customary to effect a separate rinsing step, using a cationic reagent.

Textile softening detergent compositions which combine cleaning power with softening power for textiles have also been described. German Specification DE-PS 23 34 899, for example, describes the use of clay minerals, namely of saponites, hectorites, montmorrillonites, as textile softening agents in detergent compositions, and in German Specification DE-OS 33 12 774, it has been suggested that bentonites should be added to detergent compositions for the purpose just described.

It is also known in the art that smectites can be incorporated with textile softening detergent compositions containing softening ammonium compounds (cationic surfactants) and/or amines (cf. European Specification 00 76 572 and U.S. Pat. No. 4 375 416). This is done in an attempt to produce a softening and also an antistatic effect, especially in a wash tumbler. As the cationic surfactants are embedded in the smectites (crystalline laminated alkali metal silicates) they remain active even in the presence of anionic surfactants.

Smectites are clay minerals which have a lattice charge and expand when solvated with water and alcohol. Representatives of the smectite group are

MONTMORRILLONITE $$\{(Al_{1,67}Mg_{0,33})(OH)_2[Si_4O_{10}]\}Na_{0,33},$$

HECTORITE $$\{(Mg_{2,67}Li_{0,33})(OH,F)_2[Si_4O_{10}]\}Na_{0,33}$$

and also saponite $$\{(Mg_{3-x}Al_x)(OH)_2[Si_{4-y}Al_yO_{10}]\}Na_z.$$

Bentonites are clay minerals containing montmorillonite.

The clays specified above are naturally occurring minerals more or less colored by the inclusion of impurities: this affects their use in detergent compositions. Synthetic clays can indeed be made but they lack commercial attractiveness.

It is therefore highly desirable to have textile softening substances which are free from the adverse effects described above.

We have now unexpectedly found that crystalline laminated silicates of the composition $$M_2Si_xO_{2x+1}\cdot yH_2O$$

in which x stands for a number larger than 7, preferably 7.5 to 23, y stands for a number of from 0 to 25 and M stands for sodium, potassium or hydrogen have an outstanding antistatic efficiency improving the textile feeling. The compounds are colorless, obtainable under commercially attractive conditions and free from alkaline earth metal and aluminum ions. Their molecular structure differs basically from that of the clays aforesaid; the laminated silicates suggested for use in accordance with this invention are representatives of the phyllosilicate group and they contain adhering water and/or water of crystallization.

In the above formula, M preferably stands for sodium which however may be partially replaced by a proton, depending on the respective pH value.

The power for exchanging ions of the crystalline laminated silicates is 130–400 millimol $M^+$ per 100 g anhydrous substance. In the X-ray diffraction diagram, the silicates show one or more reflexes in the region of the d-values of $3.0–4.0\cdot10^{-8}$ cm unassignable to quartz, tridymite and crystobalite.

It is possible in accordance with this invention to use naturally occurring as well as synthetic alkali metal silicates. Natural alkali metal silicates are, e.g. magadiite $Na_2Si_{14}O_{29}\cdot11H_2O$ and Kenyaite $Na_2Si_{22}O_{45}\cdot10H_2O$ (H.P. Eugster, Science, 157, pages 1177–1180 (1967)).

Synthetic products have e.g. the composition $Na_2Si_8O_{17}$, $K_2Si_8O_{17}$ or $Na_2Si_{14}O_{29}$ (R.K. Iler, J. Colloid Sci. 29, pages 648–657 (1964); German Specification DE-PS 27 42 912; G. Legaly et al., Am. Mineral. 60, pages 642–649 (1975)).

Crystalline laminated silicic acids and their alkali metal salts useful in this invention, and processes for making them have also been described in prior German Patent Applications P 34 00 130.1 and P 34 00 132.8).

The crystalline laminated silicic acids or laminated alkali metal silicates to be used in accordance with this invention can be incorporated with detergent compositions by a process customary for the production of such compositions, e.g. by a mixing, or spray mixing or spray drying operation. It is however also possible for them to be used separately.

The invention relates more particularly to a textile softening detergent composition containing from 5 to 70 wgt % of at least one surfactant, from 0.5 to 50 wgt % of at least one builder, from 1 to 20 wgt % of at least one crystalline laminated silicic acid and/or a corresponding alkali metal silicate, and standard detergent aids, the crystalline laminated silicic acid or its alkali metal salt of the general formula $$M_2Si_xO_{2x+1}\cdot yH_2O$$

in which x stands for a number larger than 7.0, M stands for sodium, potassium or hydrogen, and y stands for a number of from 0 to 25, showing one or more reflexes unassignable to quartz, tridymite and cristobalite in the X-ray diffraction diagram in the range of the d-values of $3.0–4.0 \cdot 10^{-8}$ cm.

Further preferred and optional features of the invention provide:

(a) for x in the above formula to stand for a number of from 7.5 to 23;

(b) for the crystalline laminated silicic acid or its alkali metal salt to have a power for exchanging cations of 130–400 millimol $M^+$ per 100 g, in the anhydrous state;

(c) for M in the above formula to be hydrogen, the X-ray diffraction diagram showing a very strong first line at $(3.42 \pm 0.1) \cdot 10^{-8}$ cm and a second line at $(18 \pm 4) \cdot 10^{-8}$ cm, the intensity of which is at most 75% the intensity of the first line;

(d) for M in the above formula to be sodium, the X-ray diffraction diagram showing an at least very strong line at $(3.42 \pm 0.15) \cdot 10^{-8}$ cm and a second line at $(20 \pm 2) \cdot 10^{-8}$ cm, the intensity of which is at most 75% the intensity of the first line.

The invention also relates to a process for rinsing textiles using a crystalline laminated silicic acid or an alkali metal salt thereof as a textile softening agent, the laminated silicic acid or its alkali metal salt having the general formula $$M_2Si_xO_{2x+1} \cdot yH_2O$$

in which x stands for a number larger than 7.0, preferably 7.5–23, M stands for sodium, potassium or hydrogen, and y stands for a number of from 0 to 25, the X-ray diffraction diagram showing, in the range of the d-values of 3.0 to $4.0 \cdot 10^{-8}$ cm, one or more reflexes unassignable to quartz, tridymite and cristobalite.

If marketed in granular form, it is preferable for the textile softening detergent composition of this invention to contain from 5 to 30 wgt % of one or more surfactants, from 10 to 40 wgt of one or more builders, and from 1 to 15 wgt % of one or more crystalline laminated silicic acids or their alkali metal salts, the balance being detergent aids. If marketed in liquid form, it is preferable for it to contain from 10–55 wgt % of one or more surfactants, from 0.5 to 25 wgt % of one or more builders and from 1 to 15 wgt % of one or more crystalline laminated silicic acids or their alkali metal salts, the balance being detergent aids. The textile softening detergent composition of this invention permits very good wash results to be produced. As surfactants, it preferably contains anionic, ampholytic or non-ionic substances.

Anionic surfactants comprise the water-soluble salts of higher fatty acids or resinic acids, such as the sodium or potassium soaps of coco nut, palm kernel or seed oil as well as of tallow and mixtures thereof. They also comprise higher alkyl-substituted aromatic sulfonates, such as alkylbenzene-sulfonates having from 9 to 14 carbon atoms in the alkyl group, alkylnaphtalenesulfonates, alkyltoluenesulfonates, alkylxylenesulfonates or alkylphenolsulfonates; fatty alcohol sulfates ($R\text{-}CH_2\text{-}O\text{-}SO_3Na$; $R = C_{11-17}$) or fatty alcohol ethersulfates, such as alkali metal laurylsulfate or alkali metal hexadecylsulfate, triethanolaminelaurylsulfate, sodium or potassium oleylsulfate, sodium or potassium salts of laurylsulfate ethoxylated with 2 to 6 mol ethylene oxide. Further useful anionic surfactants are secondary linear alkanesulfonates as well as $\alpha$-olefinsulfonates having a chain length of 12–20 carbon atoms.

The non-ionic surfactants are selected from compounds which have an organic hydrophobic group and a hydrophilic radical, e.g. the condensation products of alkylphenols of higher fatty alcohols with ethylene oxide, the condensation products of polypropyleneglycol with ethylene oxide or propylene oxide, the condensation products of ethylene oxide with the reaction product of ethylenediamine and propylene oxide, and long-chain tertiary amine oxides $$(C_{12}H_{25}-\overset{\overset{CH_3}{|}}{\underset{\underset{CH_3}{|}}{N}}=O).$$

The surfactants of ampholytic nature comprise: derivative of aliphatic, secondary and tertiary amines or quaternary ammonium compounds having from 8 to 18 carbon atoms and a hydrophilic group in the aliphatic radical, e.g. sodium-3-dodecylaminopropionate, sodium-3-dodecyclaminopropanesulfonate, 3-(N,N-dimethyl-N-hexadecyl-amino)-propane-1-sulfonate or fatty acid aminoalkyl-N,N-dimethylacetobetain, the fatty acid containing from 8 to 18 carbon atoms and the alkyl radical containing from 1 to 3 carbon atoms.

Builder substances which should conveniently be used in the detergent compositions of this invention comprise inorganic and organic salts which produce a slightly acid, neutral or alkaline reaction, especially inorganic and organic complex formers.

Useful salts producing a slightly acid, neutral or alkaline reaction are, e.g. the bicarbonates, carbonates or silicates of the alkali metals, and also mono, di- or trialkali metal orthophosphates, di- or tetraalkylpyrophosphates, meta-phosphates known to be complex formers, alkali metal sulfates and the alkali metals salts of organic, non-surface-active sulfonic acids, carboxylic acids and sulfocarboxylic acids containing from 1 to 8 carbon atoms can also be used. Representatives are, e.g. water-soluble salts of benzenesulfonic acid, toluene sulfonic acid or xylenesulfonic acid, water-soluble salts of sulfoacetic acid, sulfobenzoic acid, or salts of sulfodicarboxylic acids, as well as salts of acetic acid, lactic acid, citric acid, tartaric acid, oxydiacetic acid ($HOOC\text{-}CH_2\text{-}O\text{-}CH_2\text{-}COOH$), oxydisuccinic acid, 1,2,3,4-cyclopentanetetracarboxylic acid, polyacrylic acid and polymaleic acid.

Metaphosphates producing a slightly acid reaction and polyphosphates producing an alkaline reaction, especially tripolyphosphate, can also be used as builders forming complexes. It is possible for them to be partially or completely replaced by organic complex formers. The useful organic complex formers are selected, e.g. from nitrilotriacetic acid, ethylenediaminetetracetic acid, N-hydroxyethyl-ethylenediaminetriacetic acid, polyalkylene-polyamine-N-polycarboxylic acids and from further known organic complex formers; needless to say it is possible to use a combination of various complex formers.

The detergent aids used in accordance with this invention are selected from such products as the alkali metal or ammonium salts of sulfuric acid, silicic acid, carbonic acid, boric acid, alkylene-, hydroxyalkylene or aminoalkylenephosphonic acid, from bleaching agents, stabilizers for peroxide compounds (bleaching agents) and water-soluble organic complex formers.

The bleaching agents are more specifically selected from sodium perborate monohydrate or tetrahydrate, from the alkali metal salts of peroxomono- or peroxodisulfuric acid, from the alkali metal salts of peroxodiphosphoric acid ($H_4P_2O_8$). Water-soluble precipitated magnesium silicate for example, is a stabilizer for these bleaching agents. Organic complex formers are the alkali metal salts of iminodiacetic acid, nitrilotriacetic acid, ethylene-diaminetetracetic acid, methylenediphosphonic acid, 1-hydroxyethane-1,1-diphosphonic acid and nitrilotrismethylenephosphonic acid.

As still further constituents, the textile softening detergent composition of this invention may contain one or more auxiliaries improving the power of a washing liquor for suspending or peptizing dirt, e.g. carboxymethyl cellulose, carboxymethyl starch, methyl cellulose or copolymers of maleic anhydride with methylvinylether, foam regulators, such as mono- and dialkylphosphoric acid esters having from 16 to 20 carbon atoms in the alkyl group, and also optical brighteners, disinfectants and/or proteolytic enzymes.

EXAMPLE

Loop pile fabrics were washed 5 times in each case with one of the two following detergent compositions (the percentages being by wgt)

| | Composition A | Composition B |
|---|---|---|
| Sodium tripolyphosphate | 23.3 | 30 |
| Zeolite A | 15.5 | — |
| Anionic } Surfactants | 6.2 | 6.0 |
| Non-ionic } Surfactants | 3.5 | 1.5 |
| Cationic } Surfactants | — | 6.5 |
| Sodium perborate tetrahydrate | 21.0 | 20.5 |
| Sodium carbonate | 1.2 | 1.3 |
| Enzymes | 0.34 | 0.8 |
| Laminated alkali-aluminum silicate (bentonites) | — | 1.5 |
| Laminated sodium silicate (invention) | 10 | — |
| the balance up to | 100 | 100 |

being water of crystallization, adhering water and detergent aids.

Detergent composition A was a commercially available product which was mixed in accordance with this invention in a mixer with laminated crystalline sodium silicate of the formula $Na_2Si_{22}O_{45}$ (loss on ignition=4% (5 h/360° C.); detergent composition B was a commercially available product containing crystalline laminated alkali aluminum silicates and cationic surfactants said to improve the textile feeling.

The textile feeling was rated by a group of artisans who found the feeling-improving effect to be absolutely comparable. The wash results obtained in the two cases were equally very good.

We claim:

1. A textile softening detergent composition containing from 5 to 70 wgt % of at least one surfactant, from 0.5 to 50 wgt % of at least one builder, from 1 to 20 wgt % of at least one crystalline laminated silicic acid or its alkali metal salt, and standard detergent aids, the crystalline laminated silicic acid or its alkali metal salt being of the general formula $$M_2Si_xO_{2x+1}\cdot yH_2O$$

in which x stands for a number larger than 7.0, M stands for sodium, potassium or hydrogen, and y stands for a number of from 0 to 25, showing one or more reflexes unassignable to quartz, tridymite and cristobalite in the X-ray diffraction diagram in the range of the d-values of $3.0–4.0\cdot10^{-8}$ cm.

2. A textile softening detergent composition as claimed in claim 1, wherein x stands for a number of 7.5 to 23.

3. A textile softening detergent composition as claimed in claim 1, wherein the crystalline laminated silicic acid or its alkali metal salt has a power for exchanging cations of 130 to 400 millimol $M^+$ per 100 g, in the anhydrous state.

4. A textile softening detergent composition as claimed in claim 1, wherein M is hydrogen, the X-ray diffraction diagram showing a very strong first line at $(3.42\pm0.1)\cdot10^{-8}$ cm and a second line at $(18\pm4)\cdot10^{-8}$ cm, the intensity of which is at most 75% the intensity of the first line.

5. A textile softening detergent composition as claimed in claim 1, wherein M is sodium, the X-ray diffraction diagram showing an at least very strong line at $(3.42\pm0.15)\cdot10^{-8}$ cm and a second line at $(20\pm2)\cdot10^{-8}$ cm, the intensity of which is at most 75% the intensity of the first line.

6. A process for rinsing textiles using a crystalline laminated silicic acid or an alkali metal salt thereof as a textile softening agent, the laminated silicic acid or its alkali metal salt of the general formula $$M_2Si_xO_{2x+1}\cdot yH_2O$$

in which x stands for a number larger than 7.0, M stands for sodium, potassium or hydrogen, and y stands for a number of from 0 to 25, showing one or more reflexes unassignable to quartz, tridymite and cristobalite in the X-ray diffraction diagram in the range of the d-values of 3.0 to $4.0\cdot10^{-8}$ cm.

7. A textile softening, detergent composition containing from 5 to 70 wt.-% of at least one surfactant; from 0.5 to 50 wt.-% of at least one builder; and, as a textile-softening agent, from 1 to 20 wt.-% of at least one crystalline laminated silicic acid or its alkali metal salt, or mixtures of said acid and said salt, the crystalline laminated silicic acid or its alkali metal salt being of the general formula $$M_2Si_xO_{2x+1}\cdot yH_2O$$

in which x stands for a number larger than 7.0, M stands for sodium, potassium or hydrogen, and y stands for a number of from 0 to 25, showing one or more reflexes unassignable to quartz, tridymite and cristobalite in the X-ray diffraction diagram in the range of the d-values of $3.0–4.0\cdot10^{-8}$ cm.

8. A textile softening, detergent composition as claimed in claim 7, wherein the textile softening agent of said composition consists essentially of said crystalline laminated silicic acid or acids or said alkali metal salt or salts thereof, or said mixtures thereof, said composition being essentially free of alkaline earth metal and aluminum ions.

* * * * *